United States Patent [19]

Motohashi et al.

[11] Patent Number: 4,468,113

[45] Date of Patent: Aug. 28, 1984

[54] TRANSFER TYPE ELECTROSTATIC REPRODUCING APPARATUS

[75] Inventors: Mitsuo Motohashi; Mitsugu Nemoto, both of Tokyo, Japan

[73] Assignee: Konishiroku Photo Industry Co., Ltd., Tokyo, Japan

[21] Appl. No.: 433,432

[22] Filed: Oct. 8, 1982

[30] Foreign Application Priority Data

Oct. 12, 1981 [JP] Japan ..... 56-161054
Oct. 12, 1981 [JP] Japan ..... 56-161055

[51] Int. Cl.[3] ..... G03G 15/00

[52] U.S. Cl. ..... 355/14 TR; 355/3 SH; 355/14 SH; 355/14 E

[58] Field of Search ..... 355/14 SH, 3 SH, 3 TR, 355/14 CH, 14 R, 14 E, 14 TR; 271/152, 153, 171, DIG. 3, 145, 9, 265, 261

[56] References Cited

U.S. PATENT DOCUMENTS 4,190,246 2/1980 Sasuga ..... 355/14 SH X
4,341,460 7/1982 Kohyama ..... 355/14 SH X
4,382,674 5/1983 Miyoshi et al. ..... 355/14 CH

*Primary Examiner*—A. C. Prescott
*Attorney, Agent, or Firm*—James E. Nilles

[57] ABSTRACT

An electrostatic reproducing apparatus provided with a transfer paper thickness detecting element and/or a transfer paper size detecting element and an exposure device between the development device and the transfer device, the quantity of light to be irradiated onto the photosensitive member from the exposure device is adjusted according to a paper thickness information of the paper thickness detecting element and/or a paper size information of the transfer paper size detecting element. The paper thickness detecting element comprises a light emitting element and a light receiving element. The paper size detecting element comprises a magnet mounted on a paper feeding cassette and a lead switch mounted on the apparatus body side correspondingly thereto.

12 Claims, 7 Drawing Figures

F I G. I

TRANSFER TYPE ELECTROSTATIC REPRODUCING APPARATUS

BACKGROUND OF THE INVENTION

1. Field of the Invention:

This invention relates to an improvement of a transfer type electrostatic reproducing apparatus provided with a pretransfer exposure lamp to expose the surface of a photosensitive member before transfer after toner development.

2. Description of the Prior Art:

A pretransfer exposure improves a print efficiency of a toner image onto a transfer paper to lower the surface potential of a photosensitive member after toner development and also exerts an influence on a detachability at the time of detaching the transfer paper from the photosensitive member by means of a separating electrode. A conventional type of electrostatic reproducing apparatus provided with such a pretransfer exposure lamp operates on a system wherein the pretransfer exposure lamp irradiates the photosensitive member surface with a constant quantity of light at all times irrespective of the thickness and size of a transfer paper, and the transfer paper is detached by the separatng electrode at a constant discharge current. An irradiation on the photosensitive member surface by means of the pretransfer exposure lamp as described may invite a problem that the photosensitive member will be fatigued to shorten a lifetime as indicated in FIG. 1. FIG. 1 indicated a potential change on the photosensitive member surface before development after projection of an original image in a repetitive transfer, which is given from carrying out a pretransfer exposure with a light a 30 lux sec. by means of a cold cathode fluorescent tube having a peak at about 400 nm for a pretransfer exposure lamp and also from not carrying out the pretransfer exposure, with the transfer conditions other than the pretransfer exposure kept constant and same.

SUMMARY OF THE INVENTION

This invention has been done to provide a transfer type electrostatic reproducing apparatus minimized for fatigue of a photosensitive member due to pretransfer exposure and allowing a transfer paper to be detached stably and perfectly by means of a separating electrode and has been so obtained as the result of studying closely an influence of the pretransfer exposure upon transfer and detachment of the transfer paper.

Results given in Table 1 and Table 2 indicate an influence of the pretransfer exposure upon detachment of the transfer paper in a transfer type electrostatic reproducing apparatus for which the transfer paper is detached by means of a separating electrode.

Table 1 indicates a result obtained through examining a relation between a surface potential of the photosensitive member before development after projection of an original image and a detachability of the transfer paper which may arise when the original is changes, for example, from a photo original to a character original by changing a discharge current of the separating electrode, representing the case where the pretransfer exposure is not carried out. Then, Table 2 indicates a result obtained through carrying out a 30 lux sec. pretransfer exposure by means of a pretransfer exposure lamp similar as in the case of FIG. 1 under the same conditions as Table 1 except that the pretransfer exposure was carried out and a change width of a discharge current of the separating electrode was changed. For reference, symbols "○" and "X" in the tables represent the case where a transfer paper transferred to a size of A4 50 g/m$^2$ in basis weight is detached stably and perfectly and not detached stably and perfectly, respectively, and that of Se - Te system same as FIG. 1 is used for the photosensitive member.

TABLE 1

| Photosensitive member surface potenial (V) | Photosensitive member surface potential and detachability: Separating electrode discharge current (μA) 30 | 60 | 90 | 120 | 150 | 180 |
|---|---|---|---|---|---|---|
| 0 | X | X | X | ○ | ○ | ○ |
| 120 | X | X | ○ | ○ | ○ | ○ |
| 600 | ○ | X | X | X | X | X |

TABLE 2

| Photosensitive member surface potential (V) | Detachability at the time of pretransfer exposure: Separating electrode discharge current (μA) 80 | 100 | 120 | 140 | 160 | 180 |
|---|---|---|---|---|---|---|
| 0 | X | X | X | ○ | ○ | ○ |
| 120 | X | X | X | ○ | ○ | ○ |
| 600 | X | X | ○ | ○ | ○ | ○ |

The results given in Table 1 and Table 2 indicate that the pretransfer exposure is not always necessary to keep the discharge current of the separating electrode constant and also to detach the transfer paper stably.

Then, results obtained through examining the reason why a detachability of the transfer paper comes to change to a considerable degree when the photosensitive member surface potential works high at 600 V as shown in Table 1 are given in FIG. 2 and FIG. 3.

$V_1$ and $V_2$ in FIG. 2 and FIG. 3 indicate the surface potential of a transfer paper 1 immediately after the transfer paper 1 same as that in Table 1 passes a separating electrode 2 and the surface potential of a photosensitive member 3 coming on the lower side thereof respectively as shown in FIG. 4, and the surface potential $V_2$ of the photosensitive member 3 can be regarded as coming near the photosensitive member surface potential after development. A numeral 4 of FIG. 4 denotes a photosensitive member substrate, and 5 denotes a transfer electrode. Then, FIG. 2 represents the case where the photosensitive member surface potential of Table 1 is 600 V, and FIG. 3 represents the case where the photosensitive member potential is 120 V, likewise. From comparing the results of FIG. 2 and FIG. 3 with that of Table 1, it is understood that the transfer paper 1 is ready for detaching perfectly when the surface potential of the transfer paper 1 after passing the separating electrode 2 becomes almost equal to the surface potential $V_2$ of the photosensitive member coming on the lower side thereof. While the charge of the photosensitive member surface is not so eliminated by discharge of the separating electrode 2, the charge of the transfer paper 1 is suddenly eliminated when its potential is high, however, it becomes hardly eliminated as in the case of the photosensitive member surface in accordance as the potential gets low, and moreover the photosensitive member surface potential is not so influential therefor, thus obtaining the result given in Table 1. The transfer paper can therefore be detached stably by the separating electrode from keeping the photosensitive member surface potential after toner development coming near to the surface potential of the transfer paper whereat the discharge is almost saturated, and thus exposure by means of a pretransfer exposure lamp can be done so as to lower the photosensitive member surface potential after the toner development accordingly. However, the problem is actually such that the transfer paper becomes unstable for detachability due to a change in thickness, stiffness and size of the transfer paper rather than that it becomes unstable due to a change in the original.

Table 3 shows a detachability of the transfer paper according to a change in thickness of the paper, which is examined by changing the quantity of pretransfer exposure: there is given the number of transfer papers detached successfully out of those of 100 sheets under the conditions of an exposure lamp similar to that of being described on FIG. 1 working as the pretransfer exposure lamp, the transfer paper being A4-sized, the result obtained through measuring a density of the original surface after toner development on a reflection density measuring means comprising a combination of a light emitting element and a light receiving element being 1.3 (corresponding to about 300 V of the photosensitive member surface potential before development), a discharge current of the separating electrode 2 (FIG. 4) being 130 μA, a discharge current of the transfer electrode being 30 μA.

TABLE 3

| Quantity of pretransfer exposure (lux sec.) | Quantity of pretransfer exposure and detachability: Basis weight of paper (g/m²) 50 | 65 | 127 |
|---|---|---|---|
| 0 | 0 | 35 | 100 |
| 13 | 0 | 100 | 100 |
| 24 | 20 | 100 | 100 |
| 30 | 100 | 100 | 100 |

As will be apparent from the result given in Table 3, the quantity of pretransfer exposure for detachment can be retained below 30 lux sec. whereat the photosensitive member deteriorates according to the basis weight of transfer paper, and the pretransfer exposure can be omitted for the paper thick at 127 g/m².

Table 4 shows a detachability of the transfer paper according to a change in size of the paper, which is examined by changing the quantity of pretransfer exposure: there is given the number of transfer papers detached successfully out of those of 100 sheets under the conditions of an exposure lamp similar to that of being described on FIG. 1 working as the pretransfer exposure lamp, the transfer paper being 50 g/m² in basis weight, the result obtained through measuring a density of the original surface after toner development on a reflection density measuring means comprising a combination of a light emitting element and a light receiving element being 1.3 (corresponding to about 300 V of the photosensitive member surface potential before development), a discharge current of the separating electrode 2 (FIG. 4) being 130 μA, a discharge current of the transfer electrode being 30 μA, B5- and A4-sized papers being passes transversely, B4- and A3-sized papers being passes longitudinally.

TABLE 4

| Quantity of pretransfer exposure (lux sec.) | Quantity of pretransfer exposure and detachability: Size of transfer paper A3 | B4 | A4 | B5 |
|---|---|---|---|---|
| 0 | 30 | 40 | 0 | 0 |
| 13 | 100 | 100 | 0 | 0 |
| 24 | 100 | 100 | 20 | 30 |
| 30 | 100 | 100 | 100 | 100 |

From the result given in Table 4, it is understood that there may be a case where the quantity of pretransfer exposure will not be adjusted to 30 lux sec. whereat the photosensitive member deteriorates according to the transfer paper. Then, the reason why the sizes B4 and A3 are easier to detach than those of B5 and A4 is that the papers with sizes B4 and A3 are passes longitudinally or in the paper-formed direction, and while the stiffness of a paper at 50 g/m² which is used in the paper-formed direction is about 30 mg, the stiffness in the direction perpendicular to the paper-formed direction is about 15 mg to be half thereof.

Then, Table 5 indicates a transfer efficiency of the quantity of pretransfer exposure, i.e. an influence to be exerted on the ratio of a transfer toner quantity to a development toner quantity, and it is understood that even the pretransfer exposure at 15 lux sec. or so will contribute effectively to an improvement of transfer efficiency.

TABLE 5

| Pretransfer exposure (lux sec.) | Quantity of pretransfer exposure and transfer efficiency: Transfer efficiency (%) |
|---|---|
| 0 | 70 |
| 15 | 80 |
| 33 | 88 |

An A4-sized paper 50 g/m² in basis weight is used for recording paper, and conditions other than those given in the above table remain same as those of Table 4.

This invention has been done according to the results obtained as above through examinations; a transfer type electrostatic reproducing apparatus according to this invention then comprises a constitution wherein an irradiation onto a photosensitive member by means of a pretransfer exposure lamp is changed according to information of a transfer paper thickness detecting means.

Other objects and features of the invention will be elucidatory with a description of the accompanying drawings hereunder.

DESCRIPTION OF THE PREFERRED EMBODIMENTS

Figure 5:
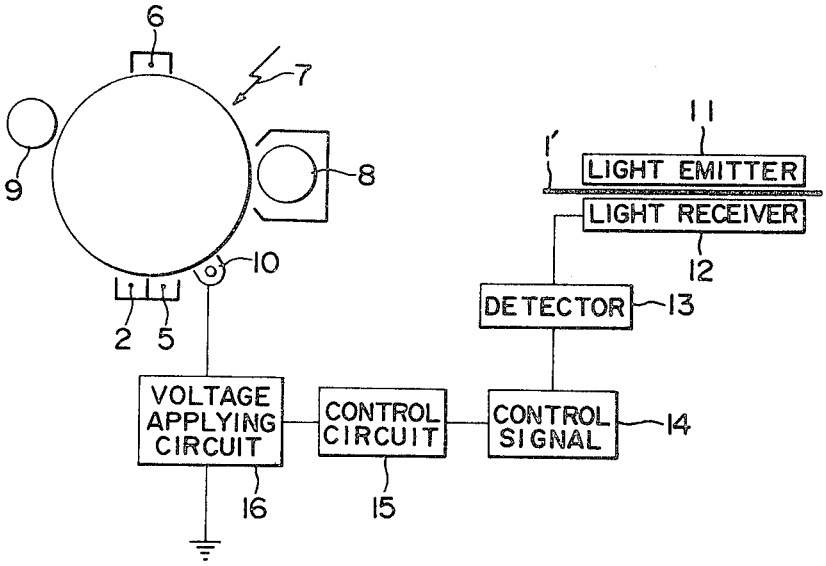
FIG. 5 is a schematic block diagram of a reproducing apparatus according to this invention.
Figure 6:
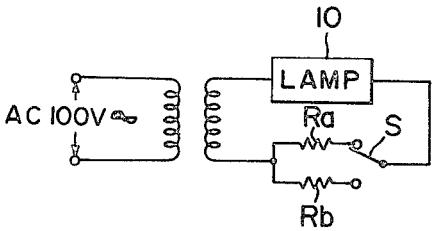
FIG. 6 is a circuit diagram representing an example of an AC voltage applying circuit.

FIG. 5 is a schematic block diagram representing an example of a reproducing apparatus according to this invention, and FIG. 6 is an AC voltage applying circuit diagram for a pretransfer exposure lamp.

Figure 1:
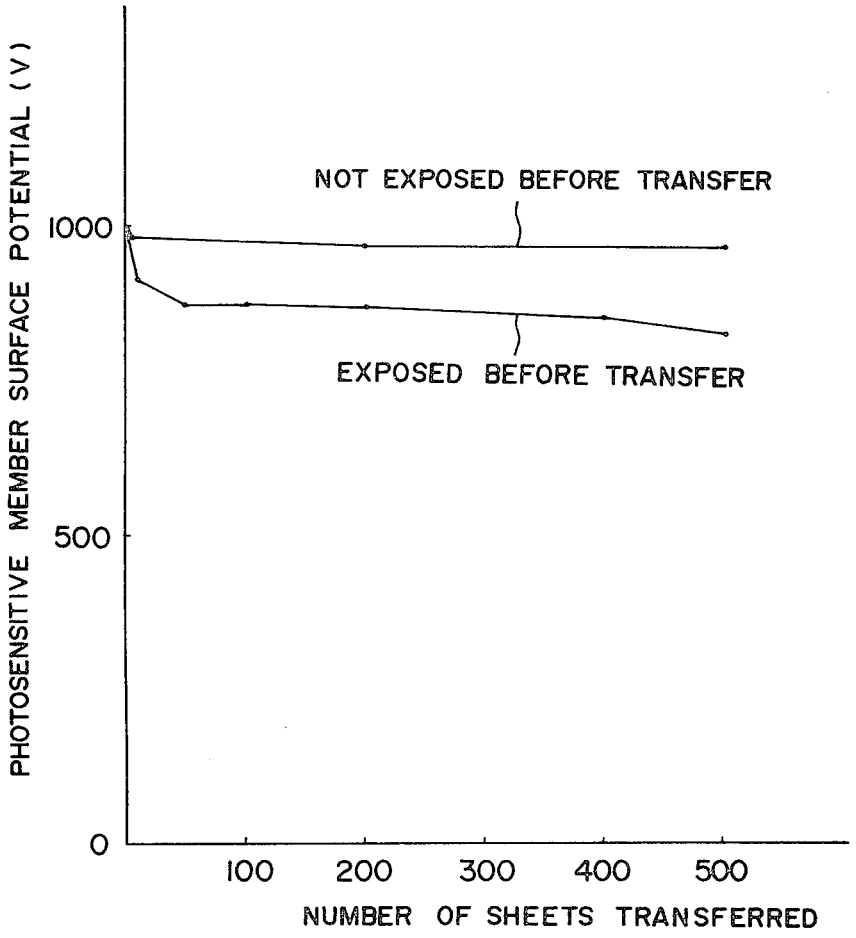
FIG. 1 is a graph indicating a fatique of a photosensitive member according to a pretransfer exposure.
Figure 2:
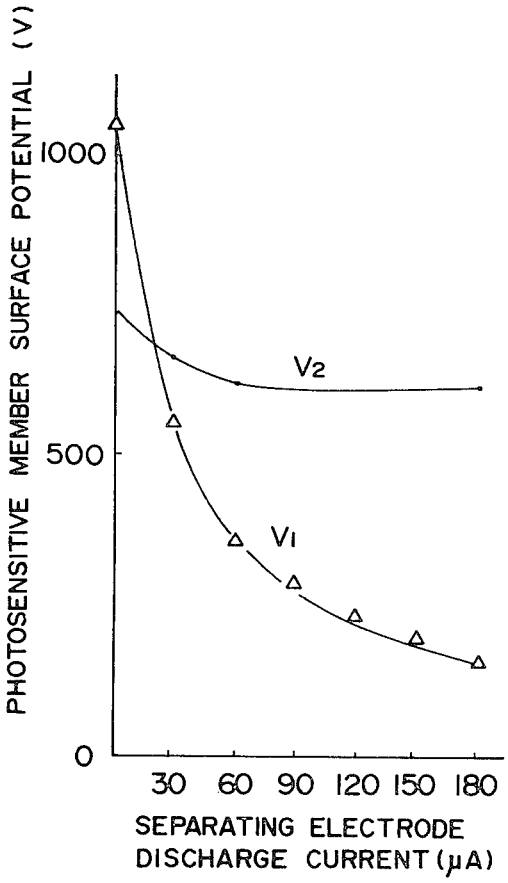
FIG. 2 and FIG. 3 are graphs indicating a relation between a photosensitive member surface potential and a detachability of a transfer paper.
Figure 3:
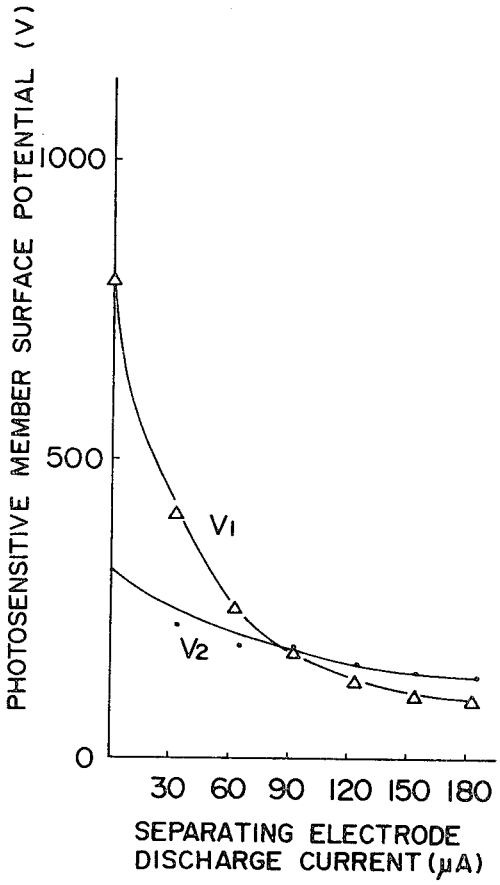
Figure 4:
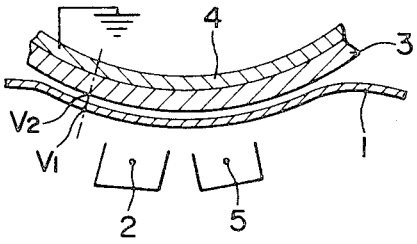
FIG. 4 is a fragmentary side view of a transfer type electrostatic reproducing apparatus, indicating measuring positions of FIG. 2 and FIG. 3.

In the drawings, 6 denotes a charging electrode to charge the surface of a phtotosensitive member 3, 7 denotes a projected light of an original image, 8 denotes a toner developing device, 9 denotes a cleaner, 10 denotes a pretransfer exposure lamp similar to that of being described on FIG. 1, 11 denotes a light emitting element to project on a transfer paper 1', 12 denotes a light receiving element to receive the light transmitted through the transfer paper 1' from the light emitting element 11 and convert it into an electrical signal, 13 denotes a detection circuit to output a thickness signal through compensating a difference in transmission factor according to the kind of papers from the electrical signal of the light receiving element 12, 14 denotes a control signal generating circuit to output a control signal from the thickness signal, 15 denotes a control circuit to send a control signal to an AC voltage applying circuit 16 at a suitable timing; in the AC voltage applying circuit 16 shown in FIG. 6, the illustration refers to a case that if the control signal of the control circuit 15 is that for the transfer paper 50 g/m$^2$ in basis weight, a change-over switch S is connected to a resistance Rb side, thereby actuating the pretransfer exposure lamp 10 for pretransfer exposure at 30 lux sec., and if the control signal is that for the paper 65 g/m$^2$ or over in basis weight, the change-over switch S is connected to a resistance Ra side, thereby actuating the pretransfer exposure lamp for pretransfer exposure at 15 lux sec. This way of constitution is effective enough to obtain a stable detachment at all times for transfer papers of different thickness even under a constant condition of a discharge current of a separating electrode being specified at 130 μA and a discharge current of a transfer electrode at 30 μA. Moreover, since the quantity of pretransfer exposure is decreased against thick transfer papers, a luminous deterioration of the photosensitive member is minimized as compared with that of working for pretransfer exposure at 30 lux sec. all the time.

Figure 7:
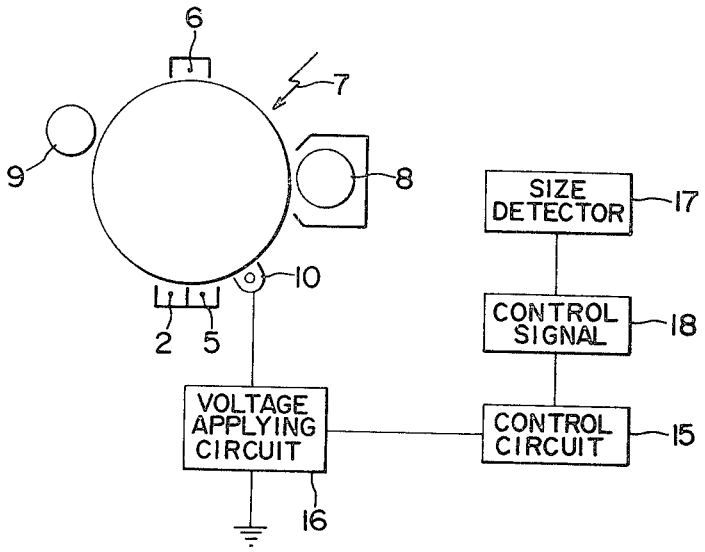
FIG. 7 is an explanatory drawing representing another embodiment of the reproducing apparatus according to the invention.

FIG. 7 represents another embodiment of the reproducing apparatus according to this invention; like reference numerals denote like parts of the apparatus in FIG. 5. In FIG. 7, 17 denotes a well-known paper size detecting circuit generating a paper size signal, comprising a combination of a magnet to give a paper size information which is mounted on a paper feeding cassette and a lead switch mounted on the reproducing apparatus body side correspondingly thereto, 18 denotes a control signal generating circuit generating a control signal upon receipt of the paper size signal. In the AC voltage applying circuit 16, an arrangement is such that the change-over switch S is connected to the resistance Rb side according to the control signal which indicates that transfer papers in the control circuit 15 are B5- and A4-sized, thereby actuating the pretransfer exposure lamp 10 for pretransfer exposure at 30 lux sec., and the change-over switch S is transferred to the resistance Ra side according to the control signal which indicates that transfer papers are B4- and A3-sized, thereby actuating the pretransfer exposure lamp 10 for pretransfer exposure at 15 lux sec. This may ensure a stable detachment all the time for the transfer paper liable to trouble, or the paper 50 g/m$^2$ in basis weight which is thinnest of all the transfer papers working normally, even under a constant condition of a discharge current of the separating electrode being specified at 130 μA and a discharge current of the transfer electrode at 30 μA. Moreover, an effect of minimizing a deterioration of the photosensitive member will be obtainable instead of carrying out the pretransfer exposure always at 30 lux sec.

This invention may be practiced otherwise for detection of thickness of the transfer paper according to a change in electrostatic capacity when the transfer paper passes between both electrodes of a capacitor or by utilizing a bending stiffness which can be detected on a load cell for correlation between thickness and bending stiffness. Further, another means using a plurality of microswitches, for exapmle, can be used for a detecting means of transfer paper sizes. Then, an incandescent lamp or a fluorescent lamp other than cold cathode fluorescent tube can be used for the pretransfer exposure lamp; a control of the quantity of pretransfer exposure is not necessarily limited to two stages, and a filter can be replaced instead of controlling the quantity of light emitted.

What is claimed is:

1. In an electrostatic reproducing apparatus which operates for developing an electrostatic latent image on a photosensitive member to a toner image through a development means and transferring said toner image to a transfer paper through a transfer means, the improvement characterized in that said electrostatic reproducing apparatus is provided with a transfer paper thickness detecting means and an exposure means between the development means and the transfer means, the quantity of light to be irradiated onto the photosensitive member from said exposure means is adjusted according to a paper thickness information of said paper thickness detecting means.

2. The apparatus as defined in claim 1, said paper thickness detecting means comprising a light emitting element and a light receiving element.

3. The apparatus as defined in claim 2, comprising a detecting circuit generating a paper thickness signal through compensating a difference in transmission factor due to the kind of paper according to an electrical signal of the light receiving element, a control signal generating circuit generating a control signal from the paper thickness signal, and a control circuit to send said control signal to an AC voltage impressing circuit.

4. The apparatus as defined in claim 1, said transfer means being a transfer electrode.

5. The apparatus as defined in claim 1, provided with a separating means on the downstream side of the photosensitive member.

6. The apparatus as defined in claim 5, said separating means being a separating electrode.

7. In an electrostatic reproducing apparatus which operates for developing an electrostatic latent image on a photosensitive member to a toner image throught a development means and transferring said toner image to a transfer paper through a transfer means, the improvement characterized in that said electrostatic reproducing apparatus is provided with a transfer paper size detecting means and an exposure means between the development means and the transfer means, the quantity of light to be irradiated onto the photosensitive member for said exposure means is adjusted according to an information of said detecting means.

8. The apparatus as defined in claim 7, said paper size detecting means comprising a magnet mounted on a paper feeding cassette and a lead switch mounted on the apparatus body side correspondingly thereto.

9. The apparatus as defined in claim 7, comprising a control signal generating circuit generating a control signal upon receipt of a paper size signal from the paper size detecting means, and a control circuit to send the control signal to an AC voltage impressing circuit.

10. The apparatus as defined in claim 7, said transfer means being a transfer electrode.

11. The apparatus as defined in claim 7, provided with a separating means on the downstream side of the photosensitive member.

12. The apparatus as defined in claim 11, said separating means being a separating electrode.

* * * * *